United States Patent [19]

Nakano et al.

[11] Patent Number: 4,530,771

[45] Date of Patent: Jul. 23, 1985

[54] LUBRICATING OIL COMPOSITIONS

[75] Inventors: Takaharu Nakano, Yokohama; Akihiro Mochizuki, Tokyo; Morikuni Nakazato, Yamato; Tatsuro Tsuneno, Wakayama, all of Japan

[73] Assignee: Karonite Chemical Co., Ltd., Tokyo, Japan

[21] Appl. No.: 517,440

[22] Filed: Jul. 26, 1983

[30] Foreign Application Priority Data

Aug. 3, 1982 [JP] Japan ..... 57-135375

[51] Int. Cl.[3] ..... C10M 1/54

[52] U.S. Cl. ..... 252/49.6

[58] Field of Search ..... 252/49.6

[56] References Cited

U.S. PATENT DOCUMENTS

| | | | |
|---|---|---|---|
| 2,795,548 | 6/1957 | Thomas et al. | 252/49.6 |
| 3,117,089 | 1/1964 | DeYoung et al. | 252/46.7 |
| 3,533,945 | 10/1970 | Vogel | 252/49.6 |
| 3,544,614 | 12/1970 | Swartz | 252/49.6 |
| 4,034,038 | 7/1977 | Vogel | 252/49.6 |
| 4,370,248 | 1/1983 | Horodysky et al. | 252/49.6 |

*Primary Examiner*—Ferris H. Lander
*Assistant Examiner*—Margaret B. Medley
*Attorney, Agent, or Firm*—Oblon, Fisher, Spivak, McClelland & Maier

[57] ABSTRACT

A lubricating oil composition containing esters constituted with glycerol, fatty acid and boric acid, which esters having carboxylic acid residue, glycerol residue and boric acid residue at a specific proportion.

The proportion for the carboxylic acid residue and glycerol residue ranges 0–2.0 mols and 1.5–2.0 mols respectively per unit mol of a boric acid residue, and the glycerol residue is 1.2 mols or more based on 1 mol of the carboxylic acid residue.

Lubricating oil additives according to the invention have almost no corrosion property in bearing portions, and do not form any solid film on themselves when allowed to stand in the air.

2 Claims, No Drawings

LUBRICATING OIL COMPOSITIONS

BACKGROUND OF THE INVENTION (i) Field of the Invention

This invention relates to a novel type of lubricating oil compositions and more particularly, to lubricating oil compositions which comprise esters constituted with glycerol, fatty acid and boric acid having specific ratios of carboxylic acid residue, glycerol residue, and boric acid residue.

(ii) Description of the Prior Art

In recent years, there is an increasing tendency toward the saving of energy. The energy saving such as in automobiles or ships has become one of great concerns. For the purpose, improvements have been steadily made on so-called hardwares such as materials and structures.

On the other hand, attention has been paid to a frictional energy loss in lubrication. Extensive studies have been made on improvements of lubricating oils in order to reduce the loss and thus to decrease energy or fuel consumption.

One of methods of reducing the frictional energy loss is to add friction reducing additives to lubricating oils.

For instance, Japanese Laid-open Application (Japan kokai) No. 55-66996 discloses fatty acid amides of diethanolamine or mixtures thereof with fatty acid esters of diethanolamine as friction reducing additive. In Japanese Laid-open Application (Japan kokai) No. 55-84394, there is described an improvement of fuel economy of internal combusion engines by addition of fatty acid glycerol esters to lubricating oils. Although these additives added to lubricating oils are found to show an improvement of fuel economy over lubricating oils containing friction reducing additives, most of them have a difficulty in practical applications because they allow a degree of corrosion in bearings at the inside of an engine mechanism to become greater than the tolerance limit of corrosion.

Japanese Laid-open Application (Japan kokai) No. 56-141398 discloses sorbitan boric esters as friction reducing additive. It is described that lubricating oil compositions comprising an effective amount of the esters can not only reduce the consumption of fuel, but also reduce a degree of corrosion at bearing portions to a minimum. However, when sorbitan boric esters are allowed to stand in air, they tend to form a thick solid film deposit on portions where exposed. Once formed, the solid deposit does no longer dissolve in lubricating oils.

As for other boric esters, boric esters of glycerol fatty acid monoesters are known in this field and are referred to in U.S. Pat. No. 2,795,548 as a corrosion inhibitor being incorporated in lubricating oils, in U.S. Pat. No. 3,117,089 as an anti-rust agent being incorporated in fuels and lubricating oils, and in Japanese Laid-open Application (Japan kokai) No. 56-150097 (European Patent Application No. 0036708) as friction reducing additives being incorporated in lubricating oils. However, in such incorporation of boric esters of glycerol fatty acid monoesters in lubricating oils, when the proportion of boric acid to glycerol fatty acid monoester is small, a degree of corrosion in bearings is allowed to become greater than the tolerance limit, on the other hand, the greater the proportion is set, the more they tend to form a thick solid film under the conditions of air-contact. Thus, it is difficult to obtain a lubricating oil which can satisfy both non-corrosive and friction reducing properties at the same time.

SUMMARY OF THE INVENTION

Accordingly, we have made intensive studies to develop lubricating oil additives which show the friction-reducing effect but have almost no corrosion property in bearing portions and which do not form any solid film on themselves when allowed to stand in the air in order to ensure the above-mentioned performance. As a result, it was found that lubricating oil compositions comprising esters constituted with glycerol, fatty acid boric acid (hereinafter referred to simply as boric esters), said boric esters having specific ratios of carboxylic acid residue, glycerol residue, and boric acid residue, satisfy the above requirement and are excellent as a lubricating oil.

DETAILED DESCRIPTION OF THE INVENTION AND PREFERRED EMBODIMENTS

The boric esters useful in the present invention may cover a variety of compounds which vary in structure depending on the types of reactants, the charge ratios, and the reaction conditions. They may be used singly or in combination provided that a moiety derived from fatty acids (i.e. carboxylic acid residues) is contained in the range of 0 to 2.0 mols, and a moiety derived from glycerol (i.e. glycerol residue) is in the range of 1.5 to 2.0 mols per unit mole of a moiety, derived from boric acid (i.e. boric acid residue) and further, molar ratio of glycerol residue to carboxylic acid residue is more than 1.2 on average of a single compound or a mixture of these compounds. Typical of the boric esters are compounds represented by the following formulas (I) and (II) or mixtures thereof.

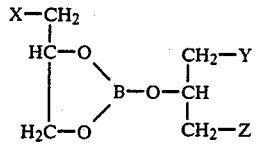

(I)

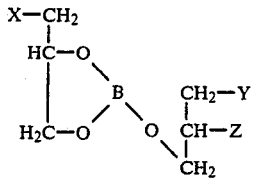

(II)

in which X, Y, and Z independently represent an OH group or a

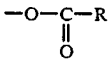

group, and R represents a saturated or unsaturated alkyl group having 7 to 23 carbon atoms.

Of these, more preferable boric esters are those compounds which comprise, based on unit mol of the boric residue, 1.0 to 1.5 mols of carboxylic acid residue, and 1.8 to 2.0 mols of the glycerol residue. Most preferably, the boric esters comprise about 1 mol of carboxylic acid residue, and about 2 mols of the glycerol residue per unit mol of the boric acid residue.

The boric esters of the present invention which meet the above-described requirements can be prepared, for example, by the following methods.

(a) Method of reacting carboxylic acid monoglyceride, glycerol, and boric acid at a temperature of 100° to 230° C.

(b) Method of reacting glycerol and boric acid and further reacting the resulting compound with carboxylic acid, lower alcohol esters of carboxylic acids, or carboxylic acid halides.

(c) Method of reacting mixtures of carboxylic acid triglycerides, glycerol, and boric acid at a temperature of about 240° to 280° C.

In these methods, it is necessary that the respective starting materials be used in amounts satisfying the aforedefined ratios of the boric acid residue, carboxylic acid residue, and glycerol residue in the final product. For instance, it is preferable to use 1 to 2 mols of carboxylic acid monoglycerides and 1 to 0 mol of glycerol per unit mol of boric acid in the method (a), 2 mols of glycerol and 1 to 2 moles of carboxylic acids or their esters or halides per unit mol of boric acid in the method (b), and 1 to 2 mols of carboxylic acid triglycerides and 4 to 5 mols of glycerol per 3 mols of boric acid in the method (c).

Carboxylic acid triglycerides used as one of the starting materials are those compounds which contain a saturated or unsaturated long-chain fatty acid residue having 8 to 22 carbon atoms. Preferable triglycerides are, for example, animal and vegetable fats such as rape seed oil, cotton seed oil, soybean oil, lard oil, beef tallow, and the like. Carboxylic acid monoglycerides may contain small amounts of di- and tri-carboxylic acid esters. Carboxylic acids useful for the purpose of the invention are preferably those acids derived from the above-indicated oils or fats, of which oleic acid or derivatives thereof are most preferable.

The lubricating oil compositions according to the invention are prepared by adding one or more boric acid esters to lubricating base oils. If desired, various known additives for lubricating oils may be further added including, for example, metallic detergents, ashless dispersants, antioxidants, extreme pressure additives, viscosity index improvers, and the like in order to attain intended performances.

The lubricating base oils which occupy a major proportion of the lubricating oil composition of the invention may be mineral lubricating oils, synthetic lubricating oils, or mixtures thereof.

Phenate and/or sulfonate are usually used as metallic neutralized detergents. The phenates are alkaline earth metal salts of alkylphenol sulfides having an alkyl group containing 8 to 30 carbon atoms. Their calcium, magnesium, or barium salts are preferably used. The sulfonates are alkaline earth metal salts of sulforic acids derived from lubricating oils having a molecular weight of about 400 to 600 or aromatic compounds having alkyl groups synthetically substituted. Their calcium, magnesium or barium salts are preferably used. Alternatively, alkaline earth metal salts of salicylates or phosphonates may also be used.

These metallic detergents may be of the neutral type or of the so-called "over-based" type having a total base number of 300 or higher. The detergents are added in an amount of 0.5 to 20% by weight of the composition.

The ashless dispersants are succinimides, succinic esters, or benzylamines having an alkyl or alkenyl group with a molecular weight of about 700 to 3000. These compounds may be further reacted with boric acid. The ashless dispersants are used in an amount of 0.5 to 15% by weight of the composition.

The antioxidants, extreme pressure additives, or antiwear agents are preferably polyfunctional zinc dihydrocarbyl dithiophosphates having an alkyl or aryl group having 3 to 18 carbon atoms. The additives are added in an amount of 0.1 to 3% by weight of the composition. Phenolic or orango sulfur compounds well-known in this field are often used as antioxidants.

The lubricating oil composition according to the invention may further comprise, in a so-called multigrade oil, viscosity index improvers such as polyalkylmethacrylates, ethylene-propylene copolymers, styrene-butadiene copolymers, and the like. As a matter of course, active viscosity index improvers which are obtained by imparting dispersability to viscosity index improvers may also be used.

Aside from the additives described above, the lubricating oil composition of the invention may still further comprise other additives which are generally used such as anti-wear agents, antirust agents, corrosion inhibitors, metal deactivators, antifoam agents, and the lile. These additives are used within ranges of amounts ordinarily employed for these purposes.

The boric esters compounded in the lubricating oil composition of the invention show their effect when added in an amount exceeding about 0.05%. Larger dosage, lead to an increasing effect with an attendant rise of cost. Accordingly, the dosage should be determined taking into account the balance between the saving of fuel and the cost. In general, the esters are used in an amount of 0.05 to 5 wt%, preferably 0.2 to 1.5 wt%.

Preparatory examples of boric esters and examples of the invention are described hereinbelow.

PREPARATORY EXAMPLE 1

35.4 g (0.57 mol) of boric acid was charged into a mixture of 200 g (0.57 mol) of commercially available glycerol monooleate and 52.6 g (0.57 mol) of glycerol, followed by reaction at a temperature of 210° to 220° C. while blowing nitrogen gas thereinto. 26.5 g of the water produced by the reaction was removed from the reaction system. As a result, a milky white paste product having an acid value of 124 was obtained. The analysis revealed that the product had a composition of a mixture of boric esters of the general formulas (I) and (II), a small amount of oleic acid glyceride, and a very small amount of glycerol. A major proportion of the composition was found to be boric esters of the general formulas (I) and (II) in which one of X, Y, and Z was $RCO_2$ group (oleic acid residue) and the other two substituents were both a hydroxyl group.

PREPARATORY EXAMPLE 2

15.5 g (0.25 mol) of boric acid was charged into 46 g (0.5 mol) of glycerol, followed by reaction at a temperature of 200° to 210° C. while blowing nitrogen gas thereinto and removing 13 g of produced water. To the reaction product was added 69.1 g (0.25 mol) of commercially available oleic acid, followed by reaction in a stream of nitrogen gas at a temperature of 210° to 220° C. for 3 hours and then removing 4.5 g of produced water. As a result, a light brown, transparent, liquid product having an acid value of 129 was obtained. The analysis revealed that the product had a composition comprising a mixture, based on the rough molar ratio, of about 50% of boric esters of the general formulas (I) and (II) in wich one of X, Y, and Z is an $RCO_2$ group and the other two are independently hydroxy group, about 25% of boric esters of the formulas in which two of X, Y, and Z are independently $RCO_2$ groups, and the other is a hydroxyl group, about 25% of boric esters of the formulas in which X, Y and Z are all hydroxy groups and a small amount of boric esters of the formulas in which X, Y, and Z are all $RCO_2$ groups.

PREPARATORY EXAMPLE 3

20.1 g (0.32 mol) of boric acid was charged into a mixture of 97 g (0.11 mol) of rape seed oil (iodine value=120) and 50 g (0.54 mol) of glycerol, followed by reaction at a temperature of 255° to 265° C. for 5 hours while blowing nitrogen gas thereinto and removing 17.5 g of produced water from the system. As a result, there was obtained a yellow, transparent, liquid product having an acid value of 126.

The analysis revealed that the product had the fatty acid residue derived from the rape seed oil and had a composition similar to the product of Preparatory Example 2.

PREPARATORY EXAMPLE 4

24.1 g (0.39 mol) of boric acid was charged into a mixture of 116.4 g (0.13 mol) of lightly hydrogenated rape seed oil (iodine value=77) and 60 g (0.65 mol) of glycerol, followed by reaction at a temperature of 255° to 265° C. for 5 hours while blowing nitrogen gas thereinto and removing 23 g of produced water. As a result, there was obtained a light yellow paste product having an acid value of 129. The analysis revealed that the product had the fatty acid residue derived from the lightly hydrogenated rape seed oil whose saturation was relatively high, and had a composition similar to the product of Preparatory Example 2.

COMPARATIVE PREPARATORY EXAMPLE 1

19.5 g (0.32 mol) of boric acid and 70 g of commercially available n-butanol were charged into 135 g (0.32 mol) of a commercially available mixture of sorbitan monooleate and sorbitan dioleate, followed by azeotropically removing produced water under reflux. Thereafter, the xylene was removed by distillation under reduced pressure, thereby obtaining a light brown liquid product.

COMPARATIVE PREPARATORY EXAMPLE 2

32.3 g (0.52 mol) or boric acid and 100 g of commercially available n-butanol were charged into 135 g (0.32 mol) of a commercially available mixture of sorbitan monooleate and sorbitan dioleate, followed by treating in the same manner as in Comparative Preparatory Example 1, thereby obtaining a light brown liquid product.

COMPARATIVE PREPARATORY EXAMPLE 3

150 g (0.43 mol) of commercially sold glycerol monooleate and 26.5 g (0.43 mol) or boric acid were charged and reacted at a temperature of 170° to 180° C. while blowing nitrogen gas thereinto and removing of 18.6 g of produced water, thereby obtaining a milky white paste product having an acid value of 154.

Lubricating oil compositions admixed with various additives were prepared and subjected to a number of tests. This is particularly described in the following examples.

COMPARATIVE PREPARATORY EXAMPLE 4

250 g (0.70 mol) of commercial glycerol monooleate and 22.1 g (0.35 mol) of boric acid were charged and reacted at a temperature of 200° to 210° C. while belowing nitrogen gas thereinto and 18.6 g of water was removed. A milky white paste product having an acid value of 85 was obtained.

EXAMPLE 1

A lubricating base line oil having the following composition (hereinafter referred to as base line) was prepared, to which boric esters of the present invention or other additives were added to give lubricating oil compositions. Coefficients of friction on these compositions were measured.

Base Line

Mineral oil: 87 (%)
Alkenyl succinimide: 6
Over based phenate and sulfonate: 2
Zinc dialkyldithiophosphate: 1
Viscosity index improver: 4 (%)
Apparatus: Soda pendulum tester The test results are shown in Table 1.

TABLE 1

| Tested Additives | Dosage (wt %) | Coefficient of Friction Temp. 60° C. | 90° C. | 120° C. | 150° C. |
|---|---|---|---|---|---|
| — | 0 (base line) | 0.142 | 0.139 | 0.134 | 0.127 |
| Preparatory Ex. 1 | 0.5 | 0.123 | 0.122 | 0.120 | 0.117 |
| Preparatory Ex. 2 | 0.5 | 0.125 | 0.123 | 0.120 | 0.119 |
| Preparatory Ex. 3 | 0.25 | 0.129 | 0.127 | 0.126 | 0.124 |
| | 0.5 | 0.125 | 0.121 | 0.119 | 0.117 |
| | 1.0 | 0.118 | 0.118 | 0.116 | 0.116 |
| Preparatory Ex. 4 | 0.5 | 0.123 | 0.123 | 0.121 | 0.114 |
| Com. Prep. Ex. 1 | 0.5 | 0.132 | 0.132 | 0.129 | 0.125 |
| Com. Prep. Ex. 3 | 0.5 | 0.128 | 0.125 | 0.127 | 0.123 |
| Commercially available product | — | 0.140 | 0.140 | 0.135 | 0.131 |

As is shown in Table 1, the lubricating oil compositions of the present invention which comprise the boric esters have lower friction coefficients, from which it will become apparent that the boric esters show an excellent effect as friction-reducing agent.

EXAMPLE 2

As an easy method of measuring the friction reduction performance in actual engines there was effected a motoring engine test by which torques of the lubricating oil compositions were measured.

A torque of a lubricating oil composition was measured by a torque meter which was connected, through a torque converter, to a rotary shaft of a gasoline engine (4 cylinders, 1968 ml) made in Japan and rotated at a given number of revolutions by electric power. A lubricating oil being tested was charged as usual and an oil temperature was maintained at a constant level on measurement of the torque.

A base line of the same as in Example 1 was used, and the base line was admixed with additives being tested to obtain lubricating oil compositions. The base line and the lubricating oil compositions were each subjected to the torque measurement according to the above-described method. The friction reduction effect was determined as a torque reduction rate relative to a torque of the base oil. The torque reduction rate (%) is calculated according to the following equation.

$$\text{Torque reduction rate (\%)} = \frac{(\text{torque of base line}) - (\text{torque of tested oil})}{(\text{torque of base line})} \times 100$$

In order to prevent carry-over effect, the apparatus was sufficiently washed after each test and reference test of the base line was conducted alternatively among series of the test in order to carefully obtain the data. The rest results are shown in Table 2.

TABLE 2

| Tested Additives | Dosage (wt %) | Torque Reduction Rate Based on Base Line (%) Number of Revolutions of Engine 500 rpm | 1000 rpm | 1500 rpm | 2000 rpm | 2500 rpm |
|---|---|---|---|---|---|---|
| — | 0 (base line) | 0 | 0 | 0 | 0 | 0 |
| Preparatory Example 1 | 0.5 | 18.7 | 3.8 | 1.4 | 2.0 | 1.8 |
| Preparatory Example 2 | 0.5 | 16.8 | 10.8 | 5.2 | 3.9 | 4.0 |
| Preparatory Example 3 | 0.5 | 21.5 | 12.2 | 6.6 | 5.1 | 4.8 |
| Preparatory Example 4 | 0.5 | 16.8 | 9.7 | 4.9 | 3.3 | 1.4 |
| Commercially available product | 0 | −1.7 | −2.0 | −1.5 | −1.8 | −1.7 |
| Comparative Preparatory Example 1 | 0.5 | 9.8 | 7.7 | 5.6 | 4.9 | 4.5 |
| Comparative Preparatory Example 3 | 0.5 | 16.4 | 10.4 | 4.7 | 3.5 | 1.9 |

From the results of Table 2, it will be seen that the lubricating oil compositions of the present invention comprising the boric esters show the remarkable torque reduction effect. The greater effect of the additives is produced at the smaller number of revolutions. This is considered as follows: boundary lubrication takes place more frequently at low speeds than at high speeds, so that the friction reduction effect becomes more pronounced at low speeds.

The test results give evidence that the boric ester-containing lubricating compositions of the present invention have the remarkable function as a friction-reducing agent.

EXAMPLE 3

In order to prove a fuel-saving effect in an actual engine, a bench test of an engine was effected at a given level of load while keeping a constant cooling water outlet temperature, oil temperature, oil pressure, fuel temperature, fuel feed pressure, air inlet temperature and the like in order to determine a fuel consumption. The engine used was made in U.S.A. and had a displacement of 5.7 liters.

As described in Example 2, the test was carefully conducted so that no influence of an oil being tested in a preceding test was carried over a subsequent test and a test of a base oil was inserted between series of the test. Average values of fuel consumptions from repeated data were calculated. The base line was the same as used in Examples 1 and 2. The test results are shown in Table 3.

TABLE 3

| Tested Additives | Dosage (wt %) | Saving rate of fuel consumption* (%) |
|---|---|---|
| — | 0 (base line) | 0 |
| Preparatory Ex. 2 | 0.5 | 3.4 |
| Preparatory Ex. 3 | 0.5 | 3.1 |

<Note>
*Average values of 4 measurements

As is apparent from the results of Table 3, the lubricating compositions of the invention comprising the ester mixtures show a remarkable fuel-saving effect when applied to the actual engine.

EXAMPLE 4

It is sometimes experienced that when friction-reducing agents showing a remarkable friction reduction effect are contained in lubricating compositions, they act to corrode bearings of internal combustion engines to such an extent as not to be tolerable, thus being not practicable. In order to check the corrosiveness, the CRC L-38 engine test well-known in this field as one of standard engine test was conducted. The test results are shown in Table 4.

TABLE 4

| Tested Additives | Dosage (wt %) | Weight loss of bearings* (mg) |
|---|---|---|
| | 0 (base line) | 31.2 |
| Preparatory Ex. 2 | 0.5 | 24.5 |
| Preparatory Ex. 3 | 0.5 | 23.0 |
| Preparatory Ex. 4 | 0.5 | 44.7 |
| Commercially available diethanolamine oleic acid amide | 0.5 | 45.8 |
| Commercially available glycerol monooleate | 0.5 | 86.2 |

Test time: 40 hours
Base line: Same as indicated in Table 1 of Example 1.
*: The pass limit is below 40 mg.

As can be seen from the results of Table 4, the lubricating compositions of the present invention comprising the boric ester additives result in a smaller weight loss of the bearings than the base line. It was found that little or no corrosion took place on the bearings but a corrosion-inhibiting characteristic appeared.

On the other hand, the lubricating compositions which were admixed with the commercially available diethanolamine oleic acid amide or the commercially available glycerol monooleate in the same amount as in the present invention did not pass the test, i.e. these additives apparently acted to corrode the bearings.

Further, lubricating oil composition formulated with the boric esters obtained in Comparative Preparatory Example 4 did not pass the test and showed corrosiveness.

EXAMPLE 5

Storage Stability Test

About 20 g of each of the products obtained in the preparatory examples and the comparative preparatory examples was charged into a 50 ml beaker (after melting when a paste product was used) and was allowed to stand at room temperature for 4 hours in the exposed state. With the products of Preparatory Examples 1 through 4, no charge was observed but with the products of Comparative Examples 1, 2 and 3, a solid film was formed on the surface. Especially, the solid film was thicker in the case of the product of Comparative Preparatory Example 2 than in the case of Comparative Preparatory Example 1. The solid film was immersed in a 100 neutral base oil but did not dissolve therein.

Comparative Examples 1 and 2 are based on the method disclosed in Japanese Lain-open Application (Japan kokai) No. 56-141398. The above results demonstrate that the ester mixtures of the present invention are more excellent in storage stability.

What is claimed is:

1. In lubrication oil composition comprising as its essential component esters constituted with a glycerol, fatty acid and a boric acid, said esters having a positive amount up to 2.0 mols of a carboxylic acid residue comprising a saturated or unsaturated alkyl group having 8 to 24 carbon atoms and 1.5 to 2.0 mols of a glycerol residue, both per unit mol of a boric acid residue on average of the boric esters used singly or in combination, molar proportion between said carboxylic acid residue and said glycerol residue being that the glycerol residue is 1.2 mols or more based on 1 mol of the carboxylic acid residue.

2. A lubricating oil composition according to claim 1, wherein the one or more esters constituted with glycerol, fatty acid and boric acid have 1.0 to 1.5 mols of the carboxylic acid residue and 1.8 to 2.0 mols of the glycerol residue per unit mol of the boric acid residue.

* * * * *